US008581819B2

(12) United States Patent
Choi

(10) Patent No.: US 8,581,819 B2
(45) Date of Patent: Nov. 12, 2013

(54) APPARATUS AND METHOD FOR DRIVING LIQUID CRYSTAL DISPLAY DEVICE

(75) Inventor: Sang Ho Choi, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1192 days.

(21) Appl. No.: 11/646,556

(22) Filed: Dec. 28, 2006

(65) Prior Publication Data

US 2008/0001873 A1 Jan. 3, 2008

(30) Foreign Application Priority Data

Jun. 30, 2006 (KR) ..... 10-2006-0061531

(51) Int. Cl.
*G09G 3/36* (2006.01)

(52) U.S. Cl.
USPC ..... 345/92

(58) Field of Classification Search
USPC ..... 345/87, 92; 349/41–42, 48, 139
See application file for complete search history.

(56) References Cited

U.S. PATENT DOCUMENTS

| | | | | |
|---|---|---|---|---|
| 6,700,558 | B1 * | 3/2004 | Itoh | 345/87 |
| 7,027,023 | B2 * | 4/2006 | Okishiro et al. | 345/94 |
| 7,133,015 | B1 * | 11/2006 | Yoshida et al. | 345/99 |
| 7,995,181 | B2 * | 8/2011 | Choi et al. | 349/141 |
| 2001/0003448 | A1 | 6/2001 | Nose et al. | |
| 2002/0140649 | A1 * | 10/2002 | Aoyama et al. | 345/87 |
| 2003/0052847 | A1 * | 3/2003 | Okishiro et al. | 345/87 |
| 2006/0145987 | A1 * | 7/2006 | Hong | 345/92 |

FOREIGN PATENT DOCUMENTS

| | | | |
|---|---|---|---|
| CN | 1472567 | A | 2/2004 |
| JP | 11-101967 | | 4/1999 |
| JP | 2000-235371 | A | 8/2000 |
| JP | 2001-091975 | | 4/2001 |
| JP | 2001-166280 | | 6/2001 |
| JP | 2001-184034 | | 7/2001 |
| JP | 2001-272651 | | 10/2001 |
| KR | 1020010062180 | A | 7/2001 |

OTHER PUBLICATIONS

Korean Office Action in counterpart Korean Application dated Nov. 20, 2012.

* cited by examiner

*Primary Examiner* — Amr Awad
*Assistant Examiner* — Stephen Bray
(74) *Attorney, Agent, or Firm* — Morgan, Lewis & Bockius LLP

(57) ABSTRACT

A liquid crystal display device includes first and second substrates facing each other with a liquid crystal layer therebetween, a first data line, a second data line, a gate line, a pixel electrode and a reset electrode on the first substrate, the first data line crossing the gate line to define a pixel region, and a common electrode on the second substrate, during a first period of a frame, the pixel electrode and the reset electrode generating a horizontal electric field with respect to the substrates, and during a second period of the frame the common electrode and the pixel and reset electrodes generating a vertical electric field with respect to the substrates.

6 Claims, 9 Drawing Sheets

APPARATUS AND METHOD FOR DRIVING LIQUID CRYSTAL DISPLAY DEVICE

The present invention claims the benefit of Korean Patent Application No. P2006-061531 filed in Korea on Jun. 30, 2006, which is hereby incorporated by reference in its entirety.

BACKGROUND OF THE INVENTION

1. Field of the Invention

Embodiments of the invention relates to a flat panel display device, and more particularly, to an apparatus and a method for driving a liquid crystal display ("LCD") device. Although embodiments of the invention are suitable for a wide scope of applications, they are particularly suitable for obtaining a rapid response speed of liquid crystal molecules, realizing an improved image quality, and obtaining a high-resolution image in an in-plane switching mode ("IPS") liquid crystal display device.

2. Discussion of the Related Art

To overcome a narrow viewing angle generated in a twisted nematic ("TN") mode LCD device, an in-plane switching mode LCD device has been studied and developed, which has the advantage of a wide viewing angle. In general, in an IPS mode LCD device, a common electrode and a pixel electrode are formed in parallel on the same substrate, and a liquid crystal material is controlled by a horizontal electric field formed between the common and pixel electrodes. In comparison, a viewing angle of an IPS mode LCD device is wider than that of a TN mode LCD device.

FIG. 1 is a schematic diagram illustrating an IPS model LCD device according to the related art. In FIG. 1, a substrate 10 includes a plurality of pixels in an active area A/A on which an image is displayed. In addition, a plurality of data drivers 30 and gate drivers 40 including integrated circuits (IC) chips are mounted on a tape carrier package (TCP) 20. The data drivers 30 provide video data signals to the active area A/A, and the gate drivers 40 provide scan signals for selectively driving the pixels in accordance with the video data signals. The TCP 20 includes a plurality of conductive lines. Thus, each of the data and gate drivers 30 and 40 is electrically connected to the active area A/A. The data drivers 30 are commonly positioned at the upper side of the substrate 10, and the gate drivers 40 are commonly positioned at the lateral side of the substrate 10.

As illustrated shown in the enlarged pixel structure in FIG. 1, a plurality of data lines Dm−1, Dm, and Dm+1, are commonly formed in a vertical direction, and a plurality of gate lines Gn are commonly formed in a horizontal direction crossing the data lines Dm−1, Dm, and Dm+1. To display color images corresponding to the video data signals, the pixels having red, green and blue color filters are arranged in order of red (R), green (G) and blue (B) with respect to the gate line Gn.

In addition, each of the pixels includes a pixel electrode PE and a common electrode CE on the substrate 10. The pixel electrode PE and the common electrode CE may be formed in parallel to or at an angle of about 45° to the data lines Dm−1, Dm, and Dm+1, to thereby form a horizontal electric field parallel to the substrate 10. Based on the structure of the pixel and common electrodes PE and CE, liquid crystal molecules are aligned by a rubbing process. The rubbing process is performed along the direction of the data lines Dm−1, Dm, and Dm+1, to thereby display a normally black mode of showing a black image on a screen when an electric field is not applied to the pixel electrode PE and the common electrode CE.

FIGS. 2(*a*) and 2(*b*) are schematic diagrams illustrating a movement of liquid crystal molecules in a pixel of an IPS mode LCD device according to the related art. FIG. 2(*a*) shows the alignment state of the liquid crystal molecules when the electric field is not formed, and FIG. 2(*b*) shows the alignment state of the liquid crystal molecules when the electric field is formed. As shown in FIG. 2(*a*), when the electric field is not applied to the pixel electrode PE and the common electrode CE, that is, PE=CE=0V, the liquid crystal molecules are maintained in the initial alignment direction. As shown in FIG. 2(*b*), if the electric field is formed by respectively applying voltages to the pixel electrode PE and the common electrode CE, for example, PE=7V and CE=0V, the liquid crystal molecules rotate in proportion to the level of the applied electric field at the direction of the electric field. As a result, the light transmittance is changed based on the rotation of the liquid crystal molecules, and such an alignment change of liquid crystal molecules is referred to as 'rising'. In addition, as the electric field dissipates between the pixel electrode PE and the common electrode CE, the liquid crystal molecules are re-aligned to the initial state as shown in FIG. 2(*a*), and such an alignment change of liquid crystal molecules is referred to as 'falling'.

On the rising movement of liquid crystal molecules according to the formation of electric field, the liquid crystal molecules are rapidly rotated in comparison with the level of the applied electric field. On the falling movement of liquid crystal molecules after the electric field dissipates, the liquid crystal molecules are slowly returned to the initial alignment in comparison with those on the rising movement. In particular, the rising movement of the liquid crystal molecules are moved rapidly since the liquid crystal molecules are rotated based on the electric field. In contrast, in case of the falling movement, the liquid crystal molecules are moved depending on properties of the liquid crystal and alignment layer, for example, the elastic coefficient, rotating viscosity, or aligning force. Accordingly, the falling where the liquid crystal molecules are moved slowly causes the inaccurate alignment of liquid crystal molecules when displaying the next frame, thereby deteriorating the image quality.

SUMMARY OF THE INVENTION

Accordingly, embodiments of the invention is directed to an apparatus and a method for driving a liquid crystal display device that substantially obviate one or more of the problems due to limitations and disadvantages of the related art.

An object of embodiments of the invention is to provide an apparatus and a method for driving a liquid crystal display device that increase a response speed of liquid crystal molecules.

Another object of embodiments of the invention is to provide an apparatus and a method for driving a liquid crystal display device that improve an image quality and the image resolution.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a liquid crystal display device includes first and second substrates facing each other with a liquid crystal layer therebetween, a first data line, a second data line and a gate line on the first substrate, the first data line crossing the gate line to define a pixel region, a pixel electrode electrically connected to the first data line, a reset electrode electrically connected to the second data line, and a common electrode on the second substrate.

In another aspect, a liquid crystal display device includes first and second substrates facing each other with a liquid crystal layer therebetween, a first data line, a second data line, a gate line, a pixel electrode and a reset electrode on the first substrate, the first data line crossing the gate line to define a pixel region, and a common electrode on the second substrate, during a first period of a frame, the pixel electrode and the reset electrode generating a horizontal electric field with respect to the substrates, and during a second period of the frame the common electrode and the pixel and reset electrodes generating a vertical electric field with respect to the substrates.

In another aspect, a method of driving a liquid crystal display device includes during a first period of a frame, applying a first voltage to a pixel electrode while applying a second voltage to a common electrode and a reset electrode, the pixel electrode and the reset electrode being on a first substrate and the common electrode being on a second substrate facing the first substrate, and during a second period of the frame, applying the first voltage to the pixel and reset electrodes while applying the second voltage to the common electrode.

In another aspect, a method of driving a liquid crystal display device includes during a first period of a frame, generating a horizontal electric field between a pixel electrode and a reset electrode, the pixel and reset electrodes formed on a first substrate of the liquid crystal display device, and during a second period of the frame, generating a vertical electric field between a common electrode and the pixel and reset electrodes, the common electrode formed on the second substrate of the liquid crystal display device.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention. In the drawings.

DETAILED DESCRIPTION OF THE PREFERRED EMBODIMENTS

Reference will now be made in detail to the preferred embodiments of the invention, examples of which are illustrated in the accompanying drawings.

Figure 1:
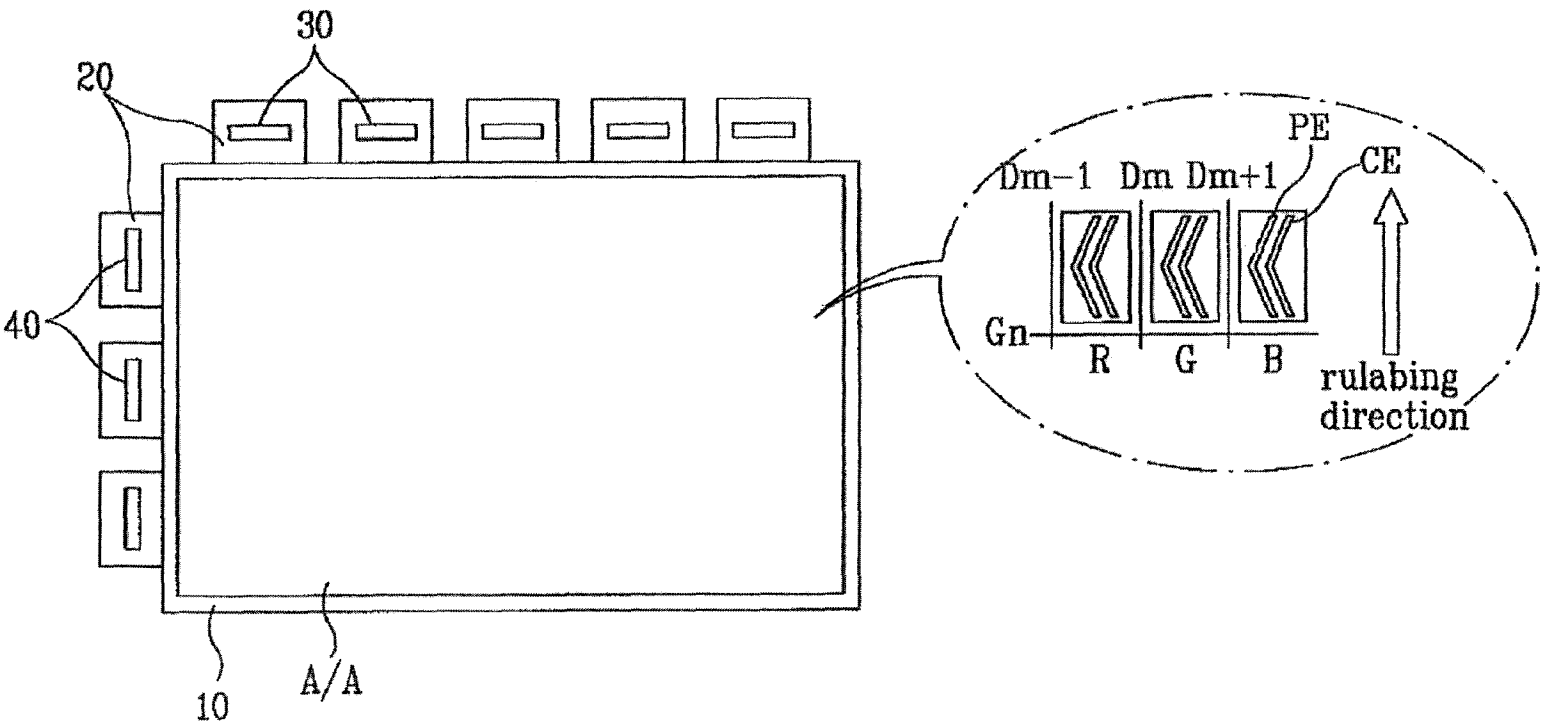
FIG. 1 Related Art
FIG. 1 is a schematic diagram illustrating an IPS model LCD device according to the related art.
Figure 2:
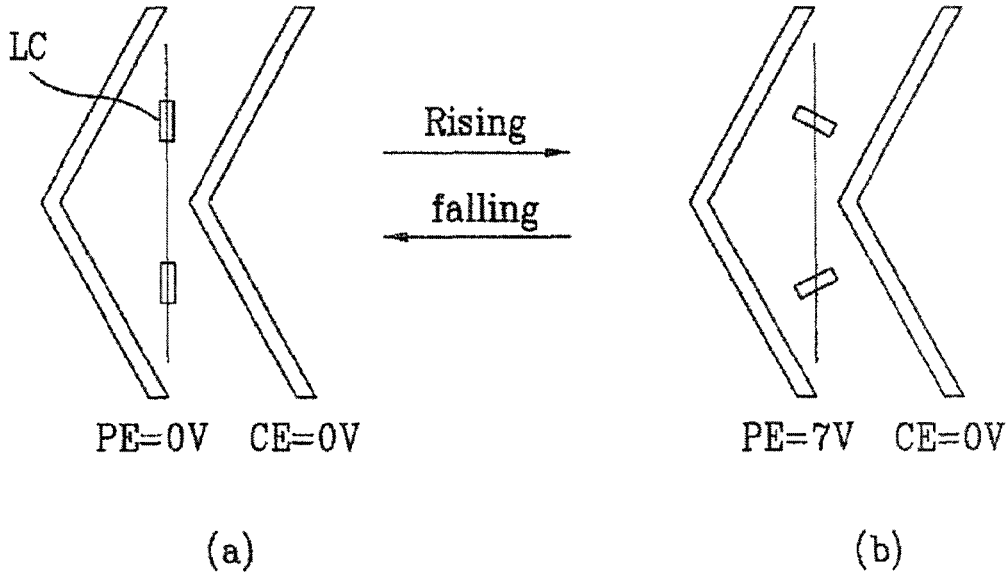
FIG. 2 Related Art
FIGS. 2(*a*) and 2(*b*) are schematic diagrams illustrating a movement of liquid crystal molecules in a pixel of an IPS mode LCD device according to the related art.
Figure 3:
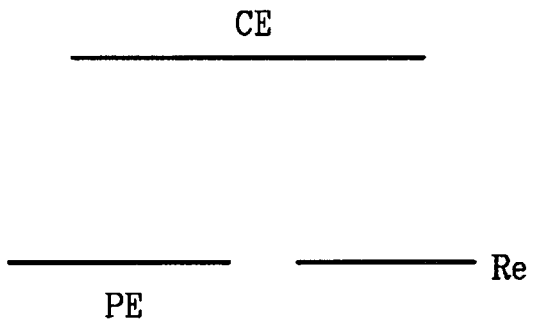
FIG. 3 is a schematic diagram illustrating an electrode structure in an IPS mode LCD device according to an embodiment of the invention.

FIG. 3 is a schematic diagram illustrating an electrode structure in an IPS mode LCD device according to an embodiment of the invention. In FIG. 3, an IPS mode LCD device includes a pixel electrode PE formed on a first substrate, and a common electrode CE formed on the entire surface of a second substrate. The first substrate is formed in opposite to the second substrate by a predetermined interval, and a liquid crystal layer (not shown) is formed between the first and second substrates.

A reset electrode Re is formed on the same substrate as that of the pixel electrode PE, and is formed on the opposite substrate to that of the common electrode CE. The reset electrode Re is formed at a predetermined interval from the pixel electrode PE, and the reset electrode Re may be formed at each pixel or may be formed by each block defined as a plurality of pixels. The reset electrode Re induces the rapid movement of liquid crystal molecules by applying the vertical electric field to the IPS mode LCD device which is driven by a horizontal electric field, wherein the horizontal electric field indicates an electric field which is parallel to the two substrates.

Figure 4:
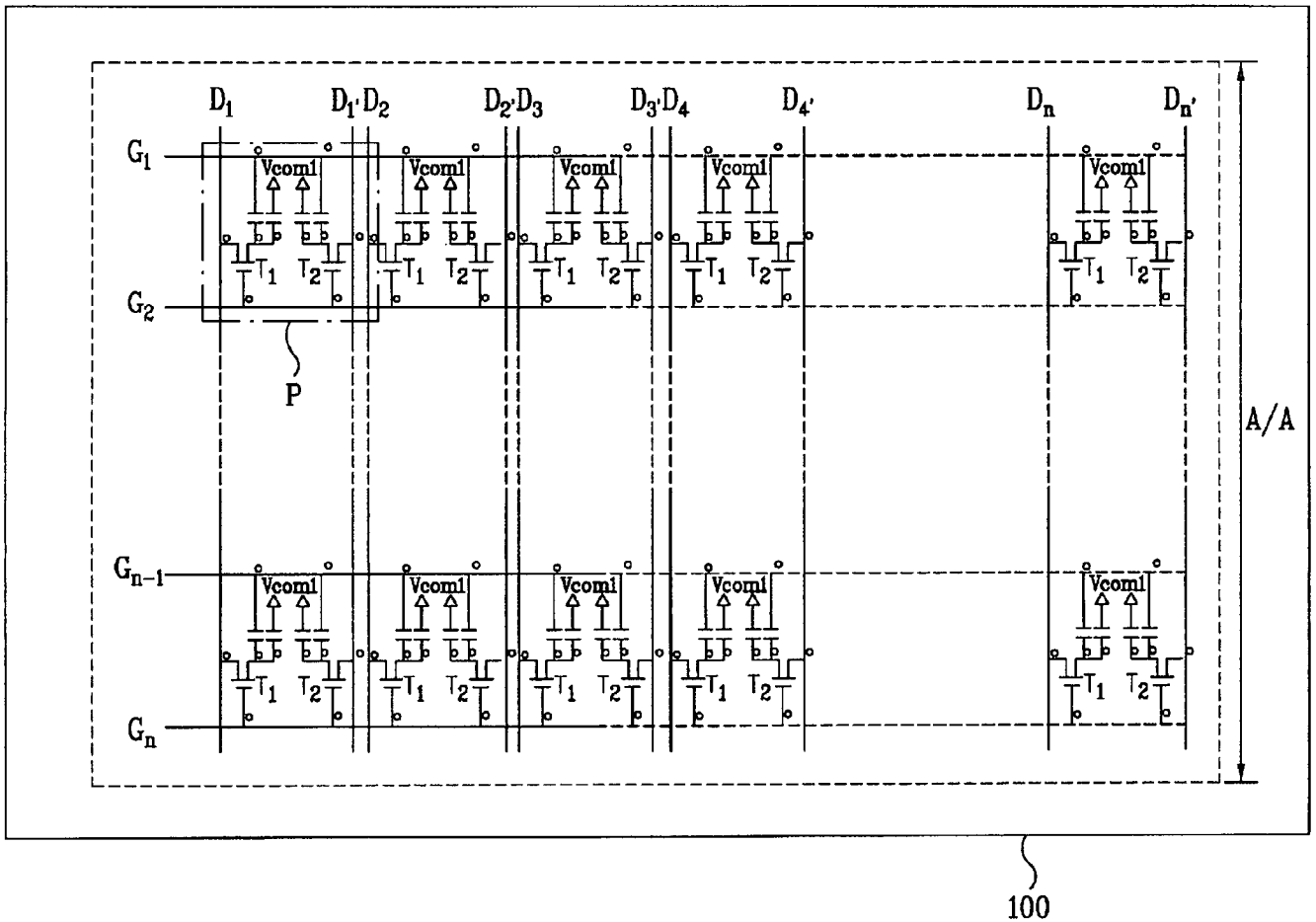
FIG. 4 is a schematic circuit diagram illustrating an IPS mode LCD device according to an embodiment of the invention.

FIG. 4 is a schematic circuit diagram illustrating an IPS mode LCD device according to an embodiment of the invention. As shown in FIG. 4, a first substrate 100 is divided into a display area having an active area A/A and a non-display area. A plurality of first data lines D1 . . . Dn, second data lines $D_1'$ . . . Dn', and gate lines G1 . . . Gn are formed on the first substrate 100. Although not shown, a second substrate is provided in opposite to the first substrate 100 to interpose a liquid crystal layer (not shown) therebetween, and a common electrode CE (not shown) is formed on an entire surface of the second substrate.

The first data lines D1 . . . Dn are formed crossing the gate lines G1 . . . Gn, to thereby define a plurality of pixel regions P. At one side of each of the pixel regions P, there is a first thin film transistor T1, which has a source electrode connected with one of the first data lines D1 . . . Dn, and a drain electrode connected to the pixel electrode PE. In addition, the second data lines D1' . . . Dn' are arranged in parallel to the first data lines D1 . . . Dn, and a second thin film transistor T2 is formed at the other side apart from the first thin film transistor T1 in each of the pixel regions P. The second thin film transistor T2 has a source electrode connected with one of the second data lines D1' . . . Dn', and a drain electrode connected to the reset electrode Re.

As the data voltage is applied to the pixel electrode PE connected to the first data lines D1 . . . Dn, the reset voltage is applied to the reset electrode Re connected to the second data line D1' . . . Dn' during a reset period. By providing the above-mentioned structure of the reset electrode Re, the vertical electric field is formed between the common and pixel electrodes CE and PE, and between the common and reset electrodes CE and Re. Thus, the IPS mode LCD device is driven with the accelerated falling speed of liquid crystal molecules.

Figure 5:
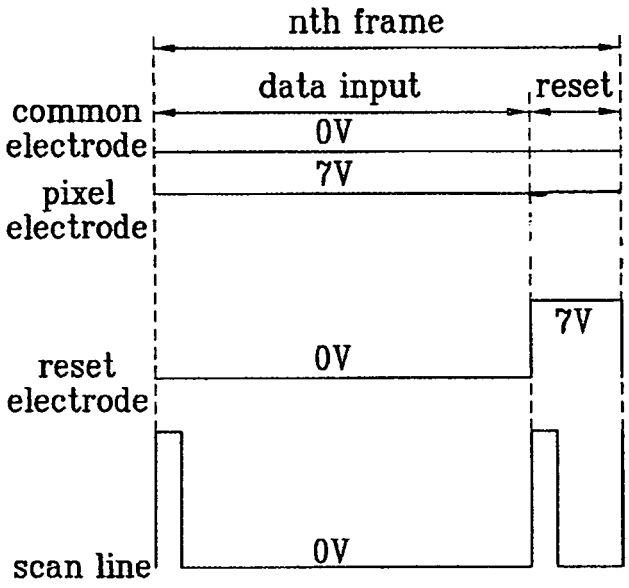
FIG. 5 is a schematic diagram illustrating exemplary operation signals for an IPS mode LCD device according to an embodiment of the invention.

FIG. 5 is a schematic diagram illustrating exemplary operation signals for an IPS mode LCD device according to an embodiment of the invention. As shown in FIG. 5, each frame includes at least a data input period and a reset period. During the data input period, a data voltage of displaying the corresponding color is applied to the pixel electrode PE of a pixel through the first data lines D1 . . . Dn, while a common voltage, for example, 0V, is applied to the reset electrode Re. The common voltage also may be applied to the common electrode CE. Thus, as a gate scanning pulse is applied to a scan line, the horizontal electric field is formed between the pixel electrode PE and the reset electrode Re along the scan line. Although a vertical electric field may be formed between the pixel electrode PE and the common electrode CE, such a vertical electric field is relatively insignificant as the distance between the pixel electrode PE and the reset electrode Re is closer than the distance between the pixel electrode PE and the common electrode CE.

During the reset period, another scanning pulse is applied to the same scan line, while a reset voltage is applied to the reset electrode Re through the second data lines D1' . . . Dn'. Meanwhile, the common voltage is continuously applied to the common electrode CE, and the data voltage is continuously applied to the pixel electrode PE. The reset voltage may be about the same as the predetermined data voltage, such as 7V. Accordingly, the vertical electric field is formed between the common electrode CE and the reset electrode Re, and between the common electrode CE and the pixel electrode PE.

Figure 6A:
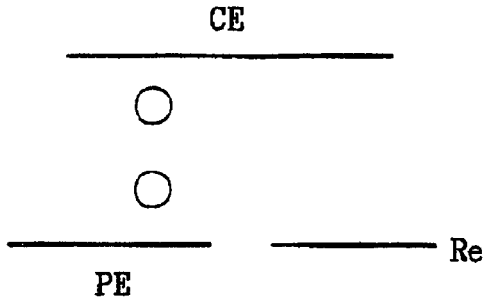
FIGS. 6A, 7A and 8A are schematic diagrams illustrating states of liquid crystal molecules in an IPS mode LCD device according to an embodiment of the invention.
Figure 6B:
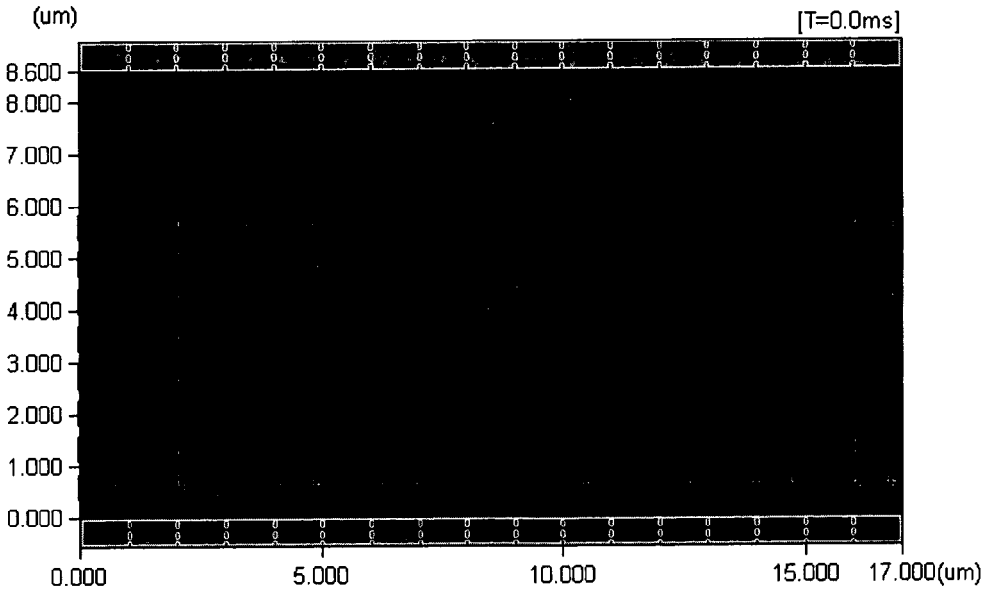
FIGS. 6B, 7B and 8B are diagrams illustrating distributions of an electric field in an IPS mode LCD device according to an embodiment of the invention.
Figure 7A:
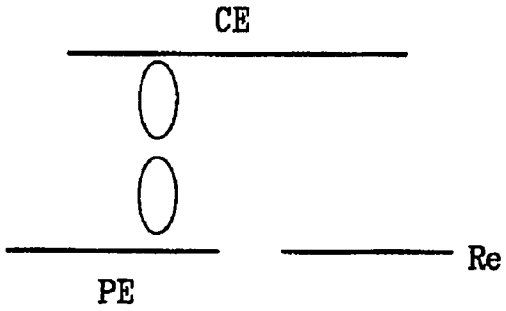
Figure 7B:
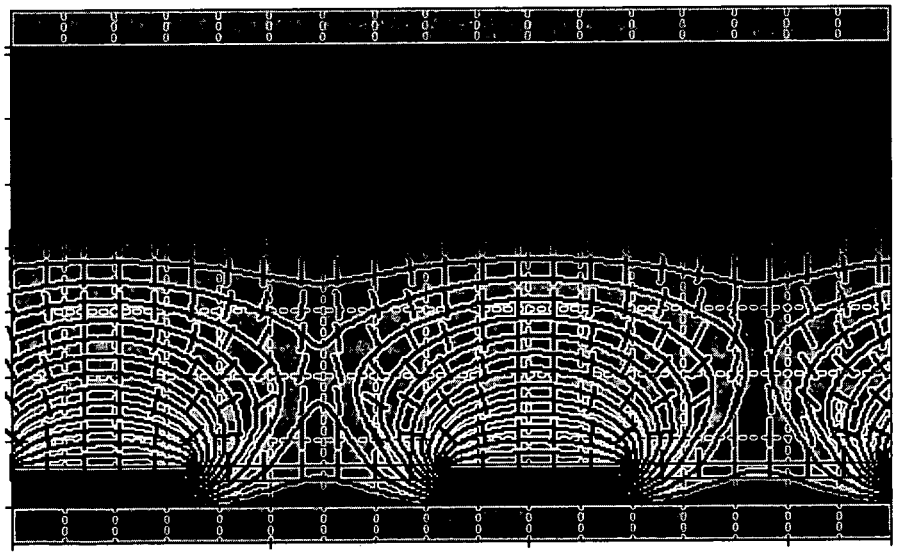
Figure 8A:
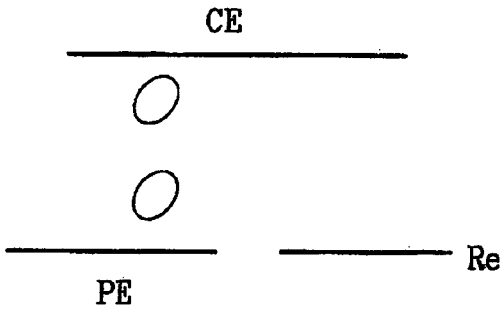
Figure 8B:
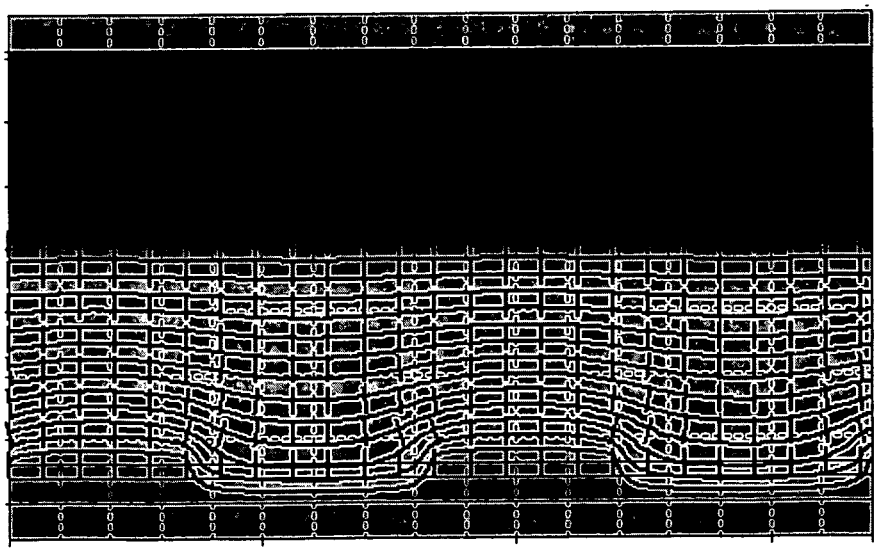

FIGS. 6A, 7A and 8A are schematic diagrams illustrating states of liquid crystal molecules in an IPS mode LCD device according to an embodiment of the invention, and FIGS. 6B, 7B and 8B are diagrams illustrating distributions of an electric field in an IPS mode LCD device according to an embodiment of the invention. In particular, FIG. 6A illustrates an initial state of liquid crystal molecules when none of the reset voltage and the data voltage is not applied to a pixel, FIG. 7A illustrates an data input state of liquid crystal molecules when the data voltage but not the reset voltage is applied to the pixel, and FIG. 8A illustrates a reset state of liquid crystal molecules when both the data voltage and the reset voltage are applied to the pixel.

FIGS. 6A and 6B illustrate the state of liquid crystal molecules when the data voltage is not applied to the pixel P in the active area A/A provided with the electrode structure of FIG. 3. As shown in FIG. 6B, there is no electrical field generated at the initial state.

As shown in FIGS. 7A and 7B, during the data input period, a predetermined data voltage of displaying the corresponding color is applied to the pixel P. For example, when the white data voltage of displaying the white color is set as the first data signal, the first data signal is applied to the pixel electrode PE through the first data line D1 in synchronization with the gate signal inputted to the gate line G1, and the common voltage is applied to the common electrode CE. Thus, as shown in FIG. 7B, the horizontal electric field is formed between the pixel electrode PE and the reset electrode Re. As a result, the liquid crystal molecules maintained in the initial alignment state of FIG. 6A are rotated to the state shown in FIG. 7A, thereby displaying white color. The white data signal may be 7V, and the common voltage may be 0V.

As shown in FIGS. 8A and 8B, during the reset period, where the vertical electric field is formed between the pixel electrode PE and the common electrode CE. During the reset period, the liquid crystal molecules having the state shown in FIG. 7A are restored to the state of FIG. 8A which is very similar to the initial alignment state. During the same frame period, an additional gate signal is applied to the pixel electrode PE and the common electrode CE of the pixel P having the first data signal inputted thereto. In synchronization with the additional gate signal, the reset voltage is applied to the reset electrode Re through the second data line Dn'. At this time, the common voltage is continuously applied to the common electrode CE, and the data voltage is continuously applied to the pixel electrode PE. Accordingly, the vertical electric field is formed between the common electrode CE and the reset electrode Re, and between the common electrode CE and the pixel electrode PE.

Since the reset electrode Re having the reset voltage is substantially identical to that of the pixel electrode PE, the vertical electric field is formed between the common electrode CE and the reset electrode Re, and between the common electrode CE and the pixel electrode PE. Accordingly, the liquid crystal molecules are restored to the initial alignment state of FIG. 8A in a short time.

Figure 9:
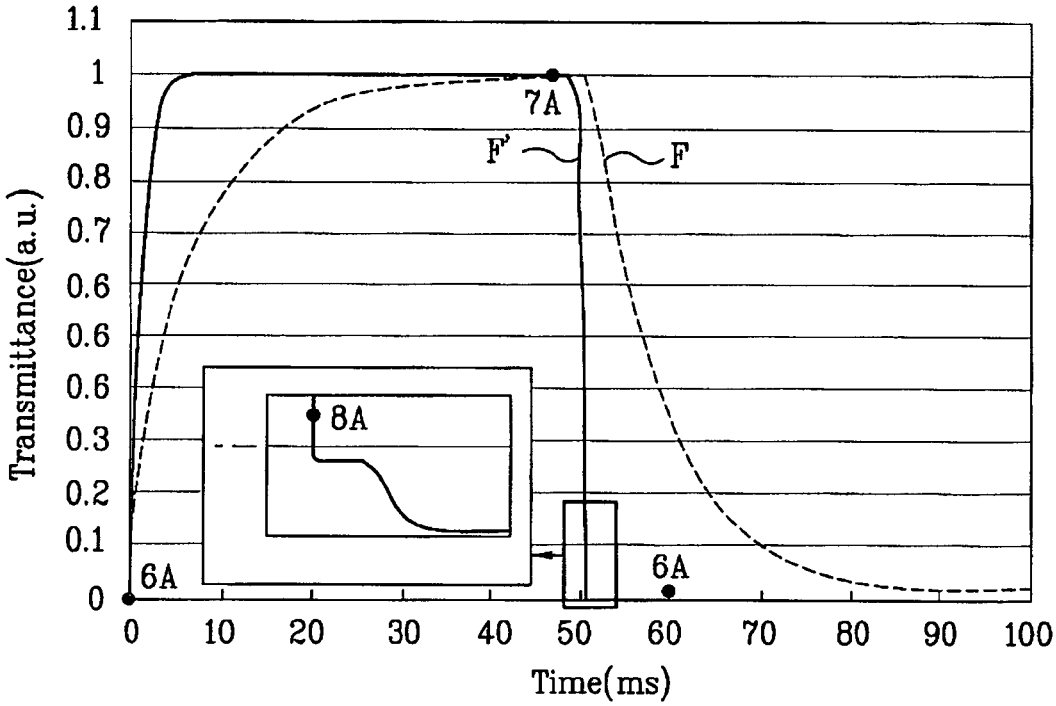
FIG. 9 is a schematic diagram illustrating difference in light transmittance on a falling (F) movement of liquid crystal molecules in an IPS mode LCD device according to the related art and in an IPS mode LCD device according to an embodiment of the invention.

FIG. 9 is a schematic diagram illustrating difference in light transmittance on a falling (F) movement of liquid crystal molecules in an IPS mode LCD device according to the related art and in an IPS mode LCD device according to an embodiment of the invention. As shown in FIG. 9, the falling speed of liquid crystal molecules in the IPS mode LCD device according to an embodiment of the invention (shown in solid line) is more rapid than the falling speed of liquid crystal molecules in the IPS mode LCD device according to the related art (shown in dashed line).

As mentioned above, the IPS mode LCD device according to an embodiment of the present invention has the following advantages. First, during the data input period, as the different voltages are applied to the pixel electrode PE and the reset electrode Re, the horizontal electric field is formed between the pixel electrode PE and the reset electrode Re. During the reset period, the same voltage is applied to the pixel and reset electrodes PE and Re, and the different voltage is applied to the common electrode CE, thereby forming the vertical electric field. As a result, it is possible to realize the rapid falling speed of liquid crystal molecules in the IPS mode LCD device according to the present invention, as compared with that of the related art IPS mode LCD device.

In case of the IPS mode LCD device according to an embodiment the present invention provided with the reset electrode, the reset voltage is applied to the reset electrode. That is, after the respond of liquid crystal based on the data signal, the falling movement of liquid crystal molecules for the input of data signal is performed with rapidness, thereby producing the accurate image on the LCD panel owing to the rapid falling movement of liquid crystal molecules.

Hence, an IPS mode LCD device according to an embodiment of the invention includes pixel, common and reset electrodes in each pixel region, to thereby realize a rapid movement of liquid crystal molecules without regard to an electric field formed by the pixel and common electrodes. In addition, an IPS mode LCD device according to an embodiment of the invention apply a reset voltage to the reset electrode at different timings from video data signals being applied to the pixel electrode. Further, an IPS mode LCD device according to an embodiment of the invention form a vertical electric field when a horizontal electrical field dissipates during an operation of the LCD device.

It will be apparent to those skilled in the art that various modifications and variations can be made in the apparatus and the method for driving a liquid crystal display device of embodiments of the invention without departing from the spirit or scope of the invention. Thus, it is intended that embodiments of the invention cover the modifications and variations of this invention provided they come within the scope of the appended claims and their equivalents.

What is claimed is:

1. A liquid crystal display device, comprising:

first and second substrates facing each other with a liquid crystal layer therebetween;

a first data line, a second data line, a gate line, a pixel electrode, and a reset electrode being formed on the first substrate, the first data line crossing the gate line to define a pixel region;

a common electrode being formed on the second substrate;

a first switching element electrically connected to the gate line and the pixel electrode; and a second switching element electrically connected to the gate line and the reset electrode, wherein during a first period of a frame, the pixel electrode and the reset electrode are configured to generate a horizontal electric field with respect to the substrates to display images;

wherein, during a second period of the frame, a reset voltage is applied to the reset electrode by the second data line in order to generate a vertical field with respect to the substrates to restore the liquid crystal molecules, wherein, an additional gate signal is applied to the first and second switching elements, in synchronization with the additional gate signal, the reset voltage is applied to the reset electrode and a data signal is applied to the pixel electrode, wherein, a voltage of a same level is applied to the pixel and reset electrodes, and a different voltage is applied to the common electrode, thereby forming the vertical electric field;

wherein the first period and the second period are different periods from each other, and wherein the reset electrode is formed for each block comprising a plurality of pixels.

2. A method of driving a liquid crystal display device, the method comprising:

during a first period of a frame, applying a first voltage to a pixel electrode while applying a second voltage to a common electrode and a reset electrode to display images, the pixel electrode and the reset electrode being formed on a first substrate and the common electrode being formed on a second substrate facing the first substrate, wherein a first gate scanning pulse is applied to a gate line to turn on a first switching element and a second switching element connected thereto, the first switching element being electrically connected to the pixel electrode and the second switching element being electrically connected to the reset electrode;

during a second period of the frame, applying the first voltage to the reset electrode and the pixel electrode while applying the second voltage to the common electrode until the liquid crystal molecules are restored, wherein a second gate scanning pulse is applied to the gate line to turn on the first switching element and the second switching element, in synchronization with the second gate scanning pulse, a reset voltage is applied to the reset electrode and the first voltage is applied to the pixel electrode, the reset voltage and first voltage comprising a same voltage, and a different voltage is applied to the common electrode, thereby forming a vertical electric field;

wherein the first period and the second period are different periods from each other, and wherein the reset electrode is formed for each block comprising a plurality of pixels.

3. The method of claim 2, wherein the first voltage corresponds to a data voltage, and the second voltage corresponds to a common voltage.

4. The method of claim 2, wherein a horizontal electric field is formed between the pixel electrode and the reset electrode during the first period.

5. The method of claim 2, wherein the vertical electric field is formed between the common electrode and the pixel and reset electrodes during the second period.

6. A method of driving a liquid crystal display device, the method comprising:

during a first period of a frame, generating a horizontal electric field between a pixel electrode and a reset electrode to display images, the pixel and reset electrodes being formed on a first substrate of the liquid crystal device, wherein a first gate scanning pulse is applied to a gate line to turn on a first switching element and a second switching element connected thereto, the first switching element being electrically connected to the pixel electrode and the second switching element being electrically connected to the reset electrode; and during a second period of the frame, generating a vertical electric field between a common electrode and the pixel and reset electrodes until the liquid crystal molecules are restored, the common electrode being formed on a second substrate of the liquid crystal display device, wherein a second gate scanning pulse is applied to the gate line to turn on the first switching element and the second switching element, in synchronization with the second gate scanning pulse, a reset voltage is applied to the reset electrode and a first voltage is applied to the pixel electrode, the reset voltage and the first voltage comprising a same voltage, and a different voltage is applied to the common electrode, thereby forming the vertical electric field;

wherein the first period and the second period are different periods from each other, and wherein the reset electrode is formed for each block comprising a plurality of pixels.

* * * * *